United States Patent [19]

Meichsner

[11] 4,309,025

[45] Jan. 5, 1982

[54] APPARATUS FOR CARRYING OUT METALLURGICAL REACTIONS IN A LADLE

[75] Inventor: Walter Meichsner, Krefeld, Fed. Rep. of Germany

[73] Assignee: Thyssen Aktiengesellschaft, Duisburg, Fed. Rep. of Germany

[21] Appl. No.: 193,739

[22] Filed: Oct. 3, 1980

[30] Foreign Application Priority Data

Oct. 4, 1979 [DE] Fed. Rep. of Germany ... 7928208[U]

[51] Int. Cl.[3] ..... C21C 7/02

[52] U.S. Cl. ..... 266/216; 75/53; 75/58

[58] Field of Search ..... 266/216; 75/59, 60, 75/53, 58, 49

[56] References Cited

U.S. PATENT DOCUMENTS

| | | | |
|---|---|---|---|
| 3,991,988 | 11/1976 | Kawai | 266/216 |
| 4,001,009 | 1/1977 | Bauer | 75/60 |
| 4,036,635 | 7/1977 | Klapdar | 75/58 |
| 4,214,899 | 7/1980 | Radzilowski | 75/58 |

*Primary Examiner*—P. D. Rosenberg

*Attorney, Agent, or Firm*—Kenyon & Kenyon

[57] ABSTRACT

A ladle covered by a lid suitable for carrying out metallurgical reactions, particularly desulphurization, characterized by the fact that the lid is spaced above the ladle so that the edge of the lid overlaps the edge of the ladle, thereby forming an annular slot. A collar open at the top and bottom is inserted in the ladle and is attached to the lid to form outlets for ambient air.

9 Claims, 1 Drawing Figure

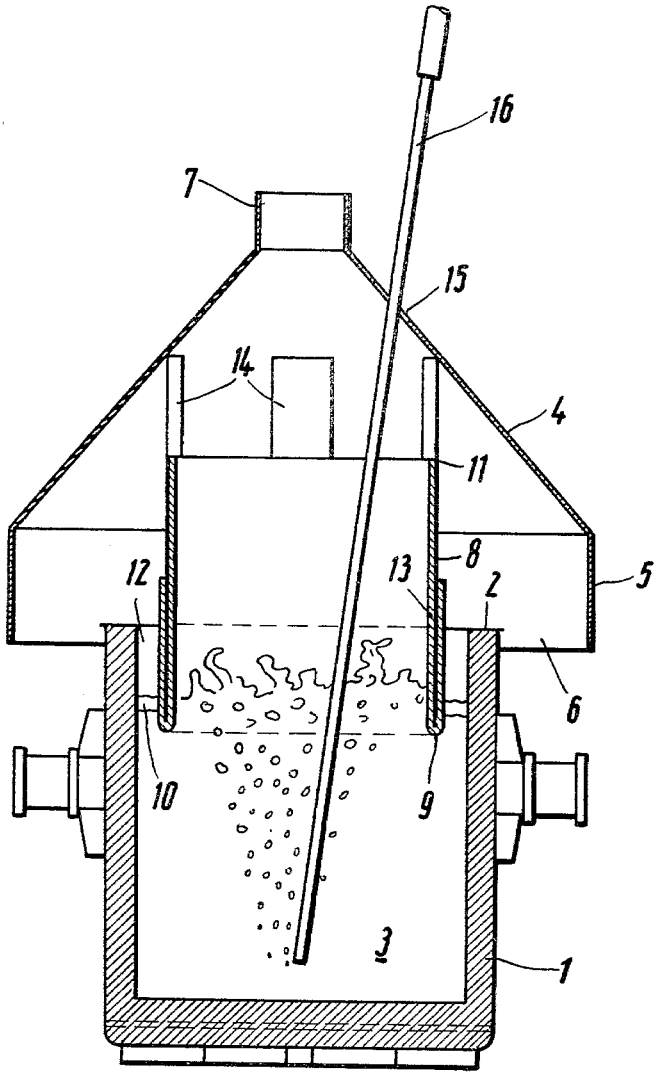
16
7
15
14
4
11
8
12
13
2
5
6
10
9
3
1

APPARATUS FOR CARRYING OUT METALLURGICAL REACTIONS IN A LADLE

BACKGROUND OF THE INVENTION

1. Field of the Invention

This invention relates to apparatus for carrying out metallurgical reactions under atmospheric pressure. In particular, it relates to apparatus for the desulphurization of pig iron in a ladle covered by a lid that has an opening for the introduction of reaction materials into the melt and has a connection piece for exhausting the reaction gases produced.

2. The Prior Art

In the treatment of melts in an open ladle by injection of reaction materials by way of inert gas or, in particular, by introducing gas-evolving materials into the melt, as for example in the desulphurization of pig iron, there is the danger, due to the vigorous reactions caused by the media introduced and due to the increase in the melt's volume connected therewith, that the melt may bubble over the edge of the ladle or that the melt or the slag on the surface of the bath may spill over.

It is often impossible for structural reasons to increase the height of the ladle wall. Decrease in the contents of the ladle is undesirable because it reduces the throughput performance of the unit and the production performance of the entire steel works. Furthermore, the efficiency of utilization of the reaction agent used can deteriorate considerably if the depth of the metal bath is low.

German AS No. 2051406 shows apparatus for carrying out metallurgical reaction, such apparatus including a ladle and a lid that can be set on the edge formed by the top periphery of the wall of the ladle. Argon can be introduced from below into a melt bath on a porous brick in the bottom of the ladle. One disadvantage of that apparatus is that it is difficult to position the lid tightly due to skull formation on the edge of the ladle. Such skull formation must be removed from the ladle to deslag the melt. Moreover, no protection is provided against the bubbling over of the melt or the spilling of slag and melt, as has just been described. Setting the lid on the edge of the ladle does not guarantee sufficient sealing. Finally, it is disadvantageous that practically exclusively hot reaction gases are exhausted through the connection piece.

A principal object of the present invention is to provide apparatus for carrying out metallurgical reactions in a ladle, which apparatus enables both the gases and vapors to be exhausted and prevents the contents of the ladle from spilling and bubbling over the edge of the ladle.

SUMMARY OF THE INVENTION

According to the present invention, apparatus in which metallurgical reactions can be carried out includes a ladle covered by a lid spaced above the ladle so that the edge of the lid overlaps the edge of the ladle, thereby forming an annular slot. A collar open at the top and bottom is inserted in the ladle and is attached to the lid to form outlets for ambient air. The lower edge of the collar, formed by the collar's bottom end is arranged close to, and preferably below, the normal level of the melt bath and the upper edge of the collar, formed by the collar's upper end, is arranged above the edge of the ladle.

The apparatus according to the invention enables reactions to be carried out in the open ladle, in which reaction gases have to be exhausted and there is also danger of having slag and melt spilling out during the reaction. The apparatus has proved itself especially satisfactory in the desulphurization of pig iron. Although a considerable amount of gas is evolved by decomposition of the usual desulphurization agents during the reaction, the bubbling over of the melt is prevented by the inset collar with normal ladle filling due to the device according to the invention. The turbulences caused in the melt by the reaction and the projection or upheaval of the melt at the surface of the melt bath are substantially restricted to the area within the collar and therefore the spilling of melt over the edge of the ladle is safely avoided. For this reason, the amount of freeboard over the melt is not critical. The ladle volume can therefore be utilized in optimum fashion. Also, a possible skulling of the edge of the ladle when deslagging the melt is no problem as the lid and the ladle edge do not have any screening or sealing function, as they do in known apparatus. It is of further advantage that ambient air can be drawn in through the annular slot of the lid and ladle edge to be used advantageously for cooling or where combustion of the vapors produced is necessary.

Moreover, it is possible to operate the apparatus of the pesent invention at high injection speeds and high injection rates. The better mixing of melt and reaction agents achieved by means of this apparatus leads to a considerably better utilization of the added reaction agent. Finally, the quicker flow rate of the melt reduces the temperature losses.

The size of the collar has to be made according to the diameter of the ladle. The area within the collar should be such that the turbulences of the surface of the bath, which occur due to the metallurgical reaction in the melt, remain within the area restricted by the collar, which generally encloses 60% to 80% of the surface of the melting bath.

The collar is generally produced from steel and is covered with refractory material, at least at the lower edge, preferably on the whole of its inner surface. Refractory material that repels slag is preferably used so that slag is prevented from adhering to the collar and the weight of the collar, therefore, does not increase because of an accumulation of slag.

The collar can have various shapes. It is tubular in its simplest form. However it can also be funnel-shaped, with the tip of the funnel pointing upward.

The collar can be attached to the lid rigidly, e.g. by way of struts. In order to immerse the collar in the melt, the lid should be constructed to be adjustable in height. Furthermore, it is possible to construct the suspension elements for the collar so that they can be altered longitudinally. For example, the suspension elements can be a cable line or hydraulic element. In this case the collar is lowered into the melting bath while the lid is fixed.

If an injection lance is to be used for the introduction of a reaction agent, an opening is arranged in the area of the lid that lies over the area of the surface of the melting bath enclosed by the collar. In this embodiment of the invention the introduction of the blow lance is particularly simple.

The invention is described in more detail below by way of a drawing representing an embodiment.

DETAILED DESCRIPTION OF THE INVENTION

An open ladle 1 that has an upper edge 2 is filled with a melt 3 nearly to the upper edge. A funnel-shaped lid 4 has an edge 5 that overlaps the edge 2 of the ladle 1 in such a way that an annular slot 6 remains between the edges 2 and 5. An exhaust connection piece 7 is attached to the tip of the funnel-shaped lid 4.

A collar 8 in the form of a cylinder is inserted in the ladle 1 in such a manner that the lower edge 9 of collar 8 lies just below the normal level 10 of the melt bath and the upper edge 11 of the collar extends above the edge 2 of ladle 1. The collar 8 is located in the central area of the ladle 1 so that an annular slot 12 is left between the walls of the ladle 1 and the collar 8. The collar, itself, is composed of sheet steel and its lower area immersed in the melting bath 3 is covered by refractory material 13. The collar 8 is attached to the lid 4 by means of individual struts 14 with a space between the upper edge 11 of the collar 8 and the lid 4 to provide passage openings between the struts 14 for ambient air drawn in through the annular slot 6.

An opening 15, through which an injection lance 16 is inserted for the introduction of reaction agent, is provided in the lid 4 above that portion of the area of the surface of the melting bath enclosed by the collar 8.

As the drawing shows, the reaction agent introduced by way of the injection lance causes the melting bath to boil up only in the area bounded by the collar 8. The surface of the melting bath outside this area and within the annular slot 12 remains quiet. Hence there is no danger that the melt will spill over the edge 2 of the ladle 1. The released amount of gas flows out of the collar 8 directly into the exhaust connection piece 7 and mixes with the ambient air drawn in through the annular slot 6 and the passage openings in the area of the struts 14.

What is claimed is:

1. Apparatus for carrying out a metallurgical reaction on a melt at atmospheric pressure, the apparatus comprising:

a ladle comprising an edge;

a lid spaced above the edge of the ladle, the lid comprising an edge that extends outwardly beyond the edge of the ladle to form an annular slot defined by the edges of the ladle and the lid;

an opening in the lid for introduction of reaction materials into the melt;

a connection piece connected to the lid for exhausting reaction gases produced by the reaction;

a collar open at the top and bottom attached to the lid, the upper edge of the collar being spaced below the lid and above the edge of the ladle to define a passage for ambient air, the lower edge of the collar being arranged close to the normal level of the melt in the ladle.

2. Apparatus according to claim 1 in which the apparatus is adapted for the metallurgical reaction occurring during desulphurization of pig iron.

3. Apparatus according to claim 1 in which the collar is tubular.

4. Apparatus according to claim 1 in which the collar is funnel-shaped.

5. Apparatus according to claim 1 in which the collar comprises a coating of refractory material on its lower edge.

6. Apparatus according to claim 1 comprising struts attaching the collar to the lid.

7. Apparatus according to claim 1 comprising suspension elements of adjustable length attaching the collar to the lid.

8. Apparatus according to claims 1, 2, 3, 4, 5, 6 or 7 in which the opening in the lid is located over the area of the surface of the melt bath bounded by the collar.

9. Apparatus according to claim 1 in which the lower edge of the collar is arranged below the normal level of the melting in the ladle.

* * * * *